United States Patent [19]

Jeanquartier et al.

[11] Patent Number: 5,076,169

[45] Date of Patent: Dec. 31, 1991

[54] INCENDIARY FRAGMENTATION PARTICLE, A METHOD FOR ITS PRODUCTION, AS WELL AS THE USE THEREOF

[75] Inventors: Rene Jeanquartier, Hofen; Yvonne Frey, Bolligen; Roland Hess, Thun, all of Switzerland

[73] Assignee: Schweizerische Eidgenossenschaft Vertreten Durch Die Eidg Munitionsfabrik Thun Der Gruppe Fur Rustungsdienste, Switzerland

[21] Appl. No.: 621,772

[22] Filed: Dec. 4, 1990

[30] Foreign Application Priority Data

Dec. 6, 1989 [CH] Switzerland ..... 04372/89

[51] Int. Cl.[5] ..... F42B 12/44

[52] U.S. Cl. ..... 102/364; 102/495

[58] Field of Search ..... 102/364, 495, 496, 497; 149/109.6

[56] References Cited

U.S. PATENT DOCUMENTS

| | | | |
|---|---|---|---|
| 1,153,513 | 9/1915 | Nixon | 102/364 |
| 1,216,364 | 2/1917 | Roger | 102/364 |
| 1,277,311 | 8/1918 | Hansen | 102/364 |
| 1,435,228 | 11/1922 | Hammond | 102/364 |
| 2,417,437 | 3/1947 | Nicholas | 102/364 |
| 3,580,175 | 5/1971 | Kenney et al. | 102/496 |
| 3,830,671 | 8/1974 | McArdle | 102/364 |
| 3,951,067 | 4/1976 | Schroeder | 102/364 |
| 4,381,692 | 5/1983 | Weintraub | 102/364 |
| 4,644,867 | 2/1987 | Hellner et al. | 102/495 |

FOREIGN PATENT DOCUMENTS

| | | |
|---|---|---|
| 2346141 | 7/1975 | Fed. Rep. of Germany . |
| 2278055 | 2/1976 | France . |
| 935707 | 9/1963 | United Kingdom . |

*Primary Examiner*—David H. Brown

*Attorney, Agent, or Firm*—Schweitzer, Cornman & Gross

[57] ABSTRACT

An incendiary fragmentation particle consists of a metal carrier body with ribs and a polymer incendiary mass containing a pyrophoric metal formed about the carrier body. The fragmentation particle carrier body may be formed from steel wire which is subsequently coated with the curing agent of a two-component epoxy resin and then, at raised temperature and high pressure, joined with the incendiary mass of pyrophoric metal and epoxy resin. The incendiary fragmentation particles may be used in active components of ammunition bodies in which they are preferably embedded in a matrix of epoxy resin.

7 Claims, 2 Drawing Sheets

INCENDIARY FRAGMENTATION PARTICLE, A METHOD FOR ITS PRODUCTION, AS WELL AS THE USE THEREOF

The invention relates to an incendiary fragmentation particle comprising a metallic carrier body with ribs and an incendiary body provided with the carrier body, a method for producing such an incendiary fragmentation particle, as well as active bodies containing fragmentation particles, and their use.

BACKGROUND OF THE INVENTION

An incendiary fragmentation particle is known from FR-A1-25 26 154. The incendiary mass is accommodated in a central recess at the tail section of the droplet-shaped carrier body. The ribs serve for flight stabilization of the body.

Equally known are incendiary fragmentation particles, especially for projectiles comprising an oxygen carrier provided in the incendiary mass such as disclosed in DE-A1-34 01 538.

These, however, suffer from the disadvantage of an unreliable incendiary effect due the aerodynamic heating of the incendiary fragmentation particles during their exterior ballistic flight. Also, for a given burning duration, known incendiary fragmentation particles have a relatively short action distance.

It is an object of the invention to provide incendiary fragmentation particles having good ballistic properties, capable of penetrating into the target and being amply coated with a pyrophoric mass, in order to achieve the desired incendiary effect.

BRIEF DESCRIPTION OF THE INVENTION

The above-mentioned and other objects are achieved in the present invention by applying an incendiary mass to the surface of the fragmentation particle carrier body, at least in the space between ribs formed on the body.

Production of these incendiary fragmentation particles is carried out in a method whereby, in a first step, the fragmentation particle body is coated with the curing agent of a two-component epoxy resin at room temperature. In a second step, a preheated mixture of resin and pyrophoric metal is applied to the body, which may be economically formed from a steel wire segment. A spherical shape fragmentation particle may be, which ensures a good ballistic behavior and thus, a large action distance.

The use of ribs that are of a cam-lobe-like shape has the advantage that the incendiary mass adheres well in the grooves between such ribs. The number of ribs and grooves may vary, the use of at least three mutually equally offset ribs and grooves providing for balanced flight behavior.

Preferred compositions for the incendiary mass of the present invention are mixtures of pyrophoric metals in epoxy resins. On the one hand, epoxy resins adhere well to most materials and, on the other hand, metals are relatively well embeddable in epoxy resins, via the reactive functional groups of the epoxy resins. Further, epoxy resins do not attack metals and are resistant to atmospheric effects. Zirconium, hafnium, uranium, titanium or aluminum may serve as the pyrophoric metals for the invention.

In producing the present invention, a pressing of the incendiary mass for two minutes at a pressure of 1000 to 2000 bar, and preferably at 1500 bar, has been found to be the minimum pressure duration required to ensure both good adhesion of the incendiary mass to the carrier body, as well as proper curing of the polymer. Increasing the density of the mixture under high pressure has been found useful for obtaining compact active bodies of high efficiency.

The invention is described in greater detail with the aid of different embodiments.

IN THE DRAWINGS

DETAILED DESCRIPTION OF PREFERRED EMBODIMENTS

Figure 1:
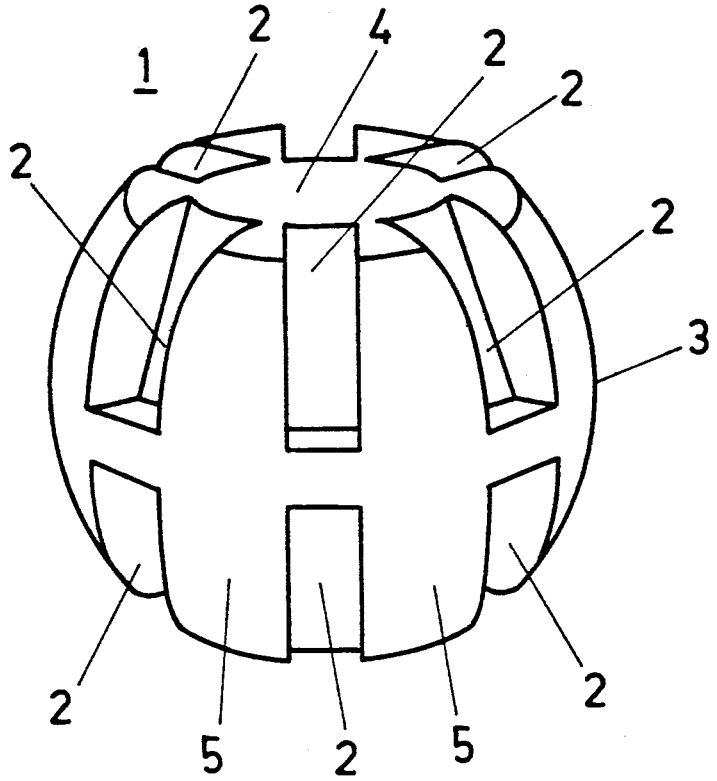
FIG. 1 is a magnified perspective view of a carrier body for the incendiary mass.

As seen in FIG. 1, the spherical carrier body 1 for the incendiary mass has two plane faces 4 and, on its enveloping surface 3, is provided with ribs 5 and grooves 2 which alternate with one another. The carrier body is made of a round steel wire from which are cut cylinders of a diameter of 4.0 mm and a length of 4.0 mm. These cylinders are then cold-pressed in a per se known manner, producing the carrier with its ribs and grooves.

Figure 2:
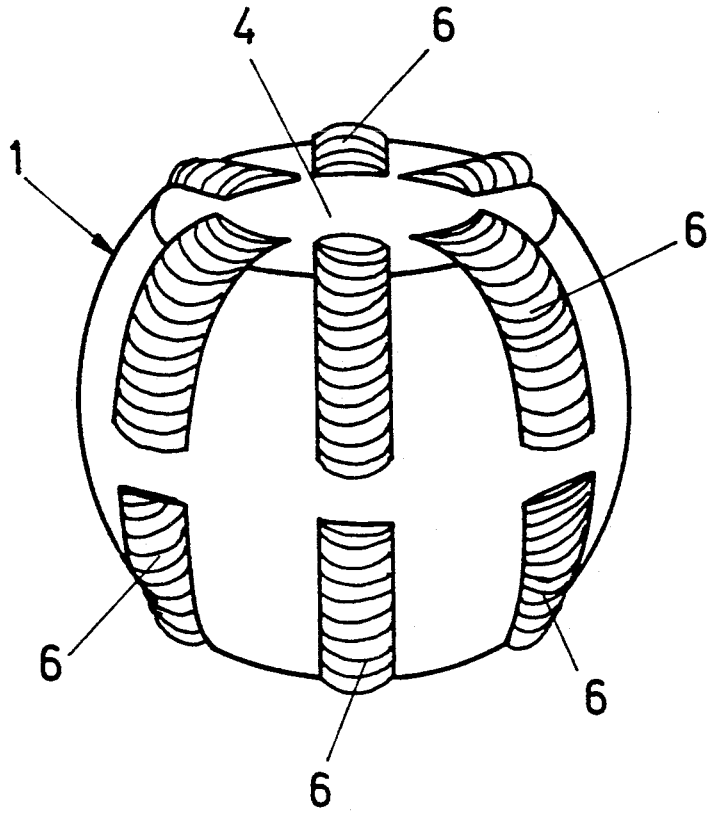
FIG. 2 is an incendiary fragmentation particle ready for action.

FIG. 2 shows the completed incendiary fragmentation particle, comprising the carrier body 1 provided with the incendiary mass 6. The incendiary mass typically fills the grooves 2 of the carrier body, but can also coat the entire surface of the carrier body. Such a preferred incendiary mass is the two-component quasi-alloy "QAZ" (trademark of Quantic Industries Inc., San Carlos, Calif., U.S.A.).

In production of the individual incendiary fragmentation particles, the carrier body 1 is degreased and lightly etched with diluted nitric acid to facilitate adhesion of the incendiary mass 6 in the grooves 2 and on the enveloping surface 3. The incendiary mass 6 is then applied to the carrier body in two stages:

The fragmentation particle body is mixed with a first partial mass comprising the viscous curing component of the QAZ-alloy at room temperature. Thus, the curing mass adheres in the grooves and to the enveloping surface of the carrier body. The second component of the QAZ-alloy, the partial mass consisting of the resin and the pyrophoric metal, is preheated to a temperature of 120° C. as recommended by the manufacturer. After that, the carrier and applied first partial mass mixture is blended with the second partial mass, homogenized by vibrating at 70 Hz and transferred to a per se known pressing tool.

During the mixing of the two partial masses, the curing agent of the first partial mass adheres primarily to the carrier body. During the compacting process at 1500 bar, the resin-powder mixture of the second partial mass penetrates into the grooves of the carrier body, displacing the adhering curing agent which subsequently uniformly diffuses into the resin mass and triggers the polymerization reaction. The incendiary mass cures mainly in the grooves of the carrier body and thus enhances the sticking power and the integrity of the incendiary fragmentation particle. At first, the polymerization reaction of the resin is slowed down due to the cold temperature of the carrier body (room temperature). In the pressing stage, polymerization is speeded up due to the previously heated resin-powder mixture. After about 5 minutes, the particles can be removed from the pressing tool and the cured particle body can be further processed and/or transferred to its application.

Active components of ammunition bodies are preferably manufactured with a plurality of incendiary fragmentation particles 1. The production process is analogous to that of the production of separate fragmentation particles. The active body is compacted in a mold of a shape appropriate to the ammunition body and is subsequently easily handled and mounted.

Figure 3:
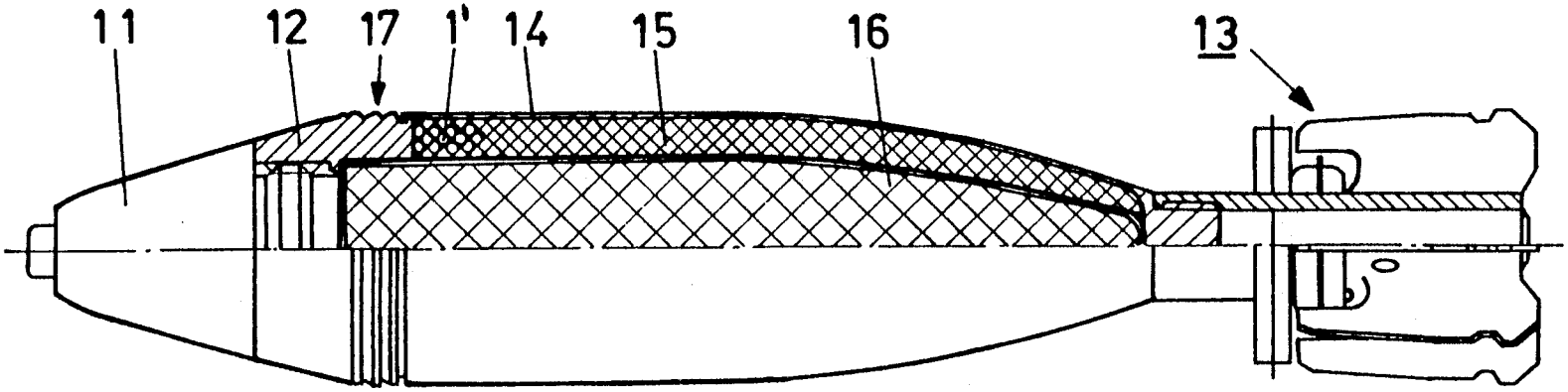
FIG. 3 shows a mortar projectile in partial section with incendiary fragmentation particles embedded in a jacket.
Figure 5:
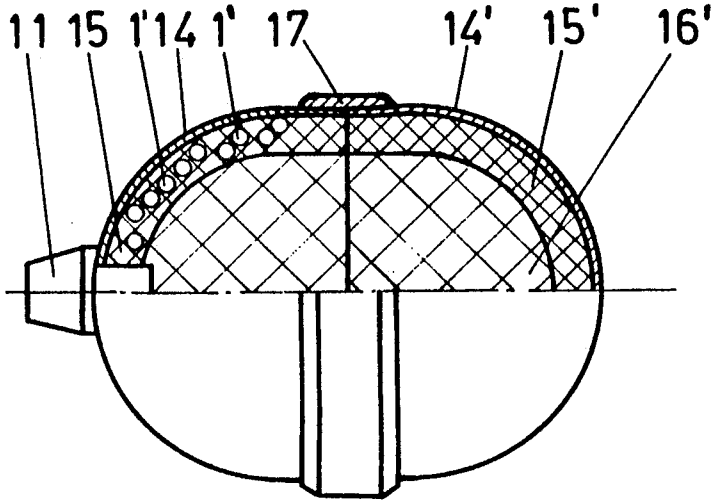
FIG. 5 is a partial sectional view of an approximately spherical ammunition body with a fragmentation-particle jacket.
Figure 4:
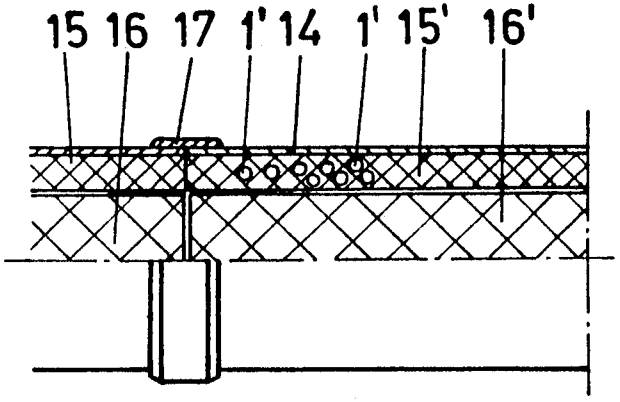
FIG. 4 illustrates a partial sectional view of a tubular explosive charge with incendiary fragmentation particles.

The embodiments shown in FIGS. 3 to 5 illustrate universal design possibilities. Components having the same function are given the same reference numerals.

A projectile head with a fuse 11 is seen in FIG. 3. A steel ring 12 serves as a connecting element to an outer projectile jacket 14 made of an aluminum alloy. At the outer diameter of the steel ring there are seen sliding rings 17, which serve for sealing and guiding the projectile in the gun barrel.

The inner jacket 15 is the active component. It is provided with a plurality of fragmentation particles 1', which are embedded in a matrix of epoxy resin. In the center of the projectile there is, as typically found, an explosive charge 16, and at the rear end of the projectile, a stabilizer unit 13.

The embodiment of FIG. 4 illustrates the use of the incendiary fragmentation particles in guidable, nonballistic rockets. Here, several inner jackets 15, 15', as well as corresponding explosive charges 16, 16' form tubular elements which are combined and joined in an end-to-end relationship by means of sealing rings 17 across the joints.

In the same way it is possible to produce spherical ammunition bodies with a radial fragmentation-particle ejection, as depicted in FIG. 5. Here, the jackets 15, 15' are here in the form of hollow hemispheres. Otherwise, the design corresponds to that of FIGS. 3 and 4, the hemispheres being joined together by circular sealing rings 17.

In all examples, the incendiary fragmentation particles 1' are preferably embedded in a matrix of QAZ-epoxy resin. Good results with all ammunition bodies were achieved with the jackets 14, 14' being made of per se known light-metal alloys, as such jackets only marginally impede fragmentation-particle ejection. It is also possible to form the jackets from impact- and temperature-resistant plastics which splinter even more easily and thus enhance the ballistic end effect of the incendiary fragmentation particles 1'. Instead of the commercially available QAZ-alloy, it is also possible to use the per se known pyrophoric metals with a two-component organic polymer. The matrix may also consist of a pyrophoric metal and/or a mild explosive, e.g., an explosive containing aluminum.

I claim:

1. An incendiary fragmentation particle comprising a metallic carrier body having ribs defining a plurality of recesses therebetween and an incendiary mass, characterized in that the incendiary mass is applied to the surface of the fragmentation particle, at least within said recesses.

2. The incendiary fragmentation particle according to claim 1, characterized in that the particle has a generally spherical enveloping surface.

3. The incendiary fragmentation particle according to claim 1, wherein the ribs are of a cam-lobe-like shape.

4. The incendiary fragmentation particle according to claim 1 or 3, wherein the ribs are at least three in number, said ribs being mutually angularly offset by equal angles.

5. The incendiary fragmentation particle according to claim 1, wherein the incendiary mass comprises at least one each of a pyrophoric metal and an organic polymer.

6. The incendiary fragmentation particle according to claim 5, wherein said pyrophoric metal is chosen from the group consisting of zirconium, hafnium, uranium, titanium and aluminum.

7. The incendiary fragmentation particle according to claim 5, wherein the organic polymer is an epoxy resin.

* * * * *